US007175234B1

(12) United States Patent
Hsieh

(10) Patent No.: US 7,175,234 B1
(45) Date of Patent: Feb. 13, 2007

(54) FOLDABLE SAFETY RAIL

(75) Inventor: Ming-Fang Hsieh, Luzhu Shiang (TW)

(73) Assignee: GE Shine Industries Corp., Luzhu Shiang (TW)

( * ) Notice: Subject to any disclaimer, the term of this patent is extended or adjusted under 35 U.S.C. 154(b) by 0 days.

(21) Appl. No.: 11/288,933

(22) Filed: Nov. 29, 2005

(51) Int. Cl.
*A47C 7/54* (2006.01)
*A47C 1/00* (2006.01)

(52) U.S. Cl. ..... 297/411.21; 297/411.38; 297/313

(58) Field of Classification Search ..... 297/411.35, 297/411.39, 411.34, 411.33, 411.22, 411.21, 297/411.2, 411.3, 411.38, 313, 335, 411.32; 248/118
See application file for complete search history.

(56) References Cited

U.S. PATENT DOCUMENTS 3,367,713 A * 2/1968 Krueger ..... 297/162
3,991,966 A * 11/1976 Breer, II ..... 248/444
5,026,028 A * 6/1991 Ooi et al. ..... 256/67
5,352,012 A * 10/1994 Chowdhury et al. ..... 297/113
5,480,173 A * 1/1996 Koniecko ..... 280/250.1
6,059,238 A * 5/2000 Reynolds et al. ..... 248/118
6,079,787 A * 6/2000 Nichols et al. ..... 297/411.39
6,102,479 A * 8/2000 Wallace ..... 297/357

* cited by examiner

*Primary Examiner*—Milton Nelson, Jr.
(74) *Attorney, Agent, or Firm*—Alan D. Kamrath; Nikolai & Mersereau, P.A.

(57) ABSTRACT

A foldable safety rail includes at least one fixing seat attachable to a wall, and at least one armrest body pivotally mounted on the at least one fixing seat. Thus, the armrest frame of the armrest body is located at the horizontal state rigidly and stably when in use so that a user holds safely the armrest frame of the armrest body so as to provide a support effect to the user. In addition, the armrest frame of the armrest body is movable to be parallel with the wall, so that the safety rail is folded when not in use, thereby saving the space occupied by the safety rail.

11 Claims, 4 Drawing Sheets

FOLDABLE SAFETY RAIL

BACKGROUND OF THE INVENTION

1. Field of the Invention

The present invention relates to a safety rail and, more particular, to a foldable safety rail.

2. Description of the Related Art

A safety rail is usually mounted on a wall that is located at a site, such as the underground passage, the subway train or the like, so that a user's one hand can hold the safety rail to obtain a support efficiently. A conventional safety rail comprises two fixing seats attachable to the wall, and a substantially U-shaped support arm mounted on the two fixing seats. Thus, the user can hold the support arm to obtain a support. However, the conventional safety rail is fixed on the wall, so that the conventional safety rail cannot be folded when not in use, thereby occupying a larger space of storage.

SUMMARY OF THE INVENTION

In accordance with the present invention, there is provided a safety rail, comprising at least one fixing seat attachable to a wall, and at least one armrest body pivotally mounted on the at least one fixing seat.

The primary objective of the present invention is to provide a foldable safety rail.

Another objective of the present invention is to provide a safety rail that is foldable when not in use, thereby saving the storage space of the safety rail.

A further objective of the present invention is to provide a safety rail safety rail, wherein the armrest frame of the armrest body is located at the horizontal state rigidly and stably when in use so that a user holds safely the armrest frame of the armrest body so as to provide a support effect to the user.

A further objective of the present invention is to provide a safety rail safety rail, wherein the armrest frame of the armrest body is movable to be parallel with the wall, so that the safety rail is folded when not in use, thereby saving the space occupied by the safety rail.

A further objective of the present invention is to provide a safety rail safety rail, wherein the safety rail functions as a chair, thereby enhancing the versatility of the safety rail.

Further benefits and advantages of the present invention will become apparent after a careful reading of the detailed description with appropriate reference to the accompanying drawings.

DETAILED DESCRIPTION OF THE INVENTION

Figure 1:
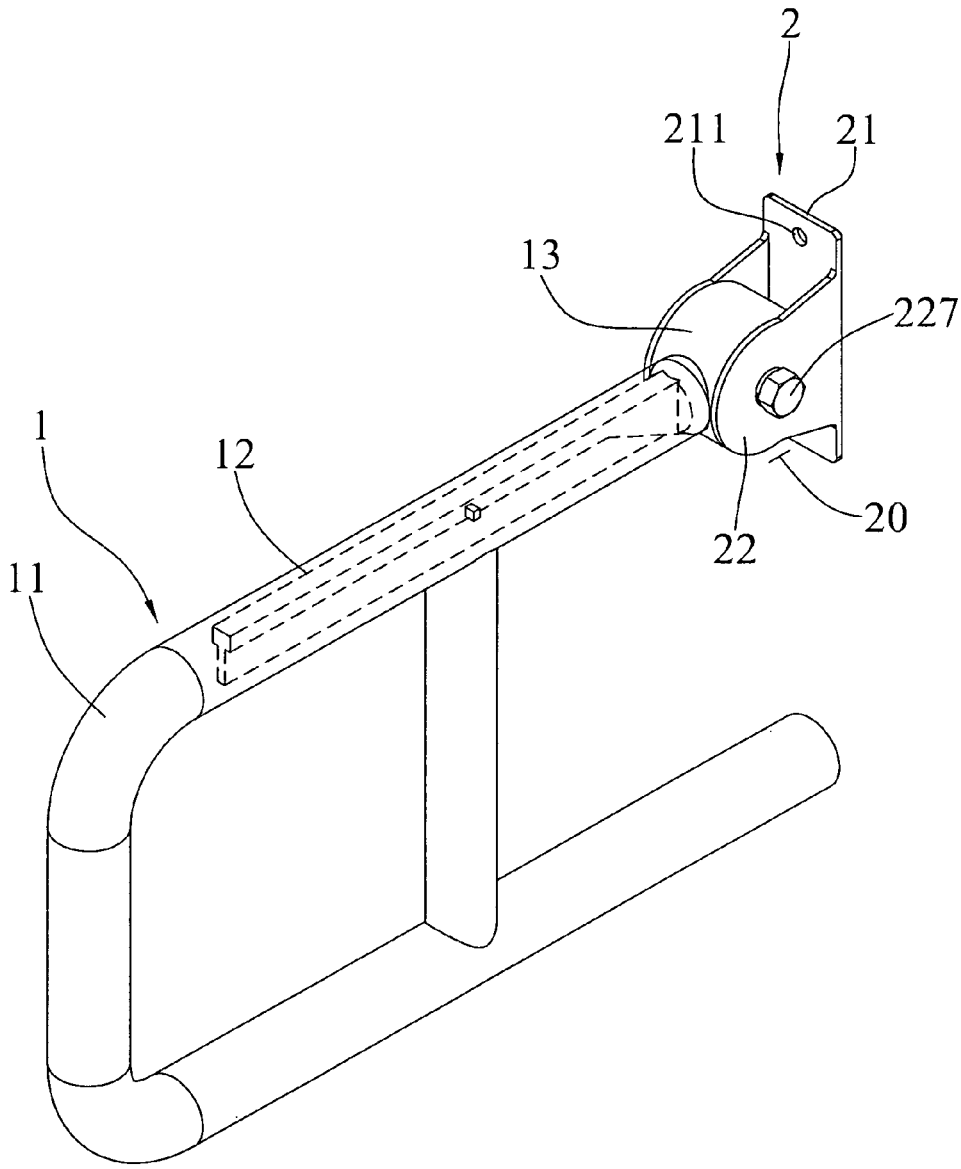
FIG. 1 is a perspective view of a safety rail in accordance with the preferred embodiment of the present invention.
Figure 2:
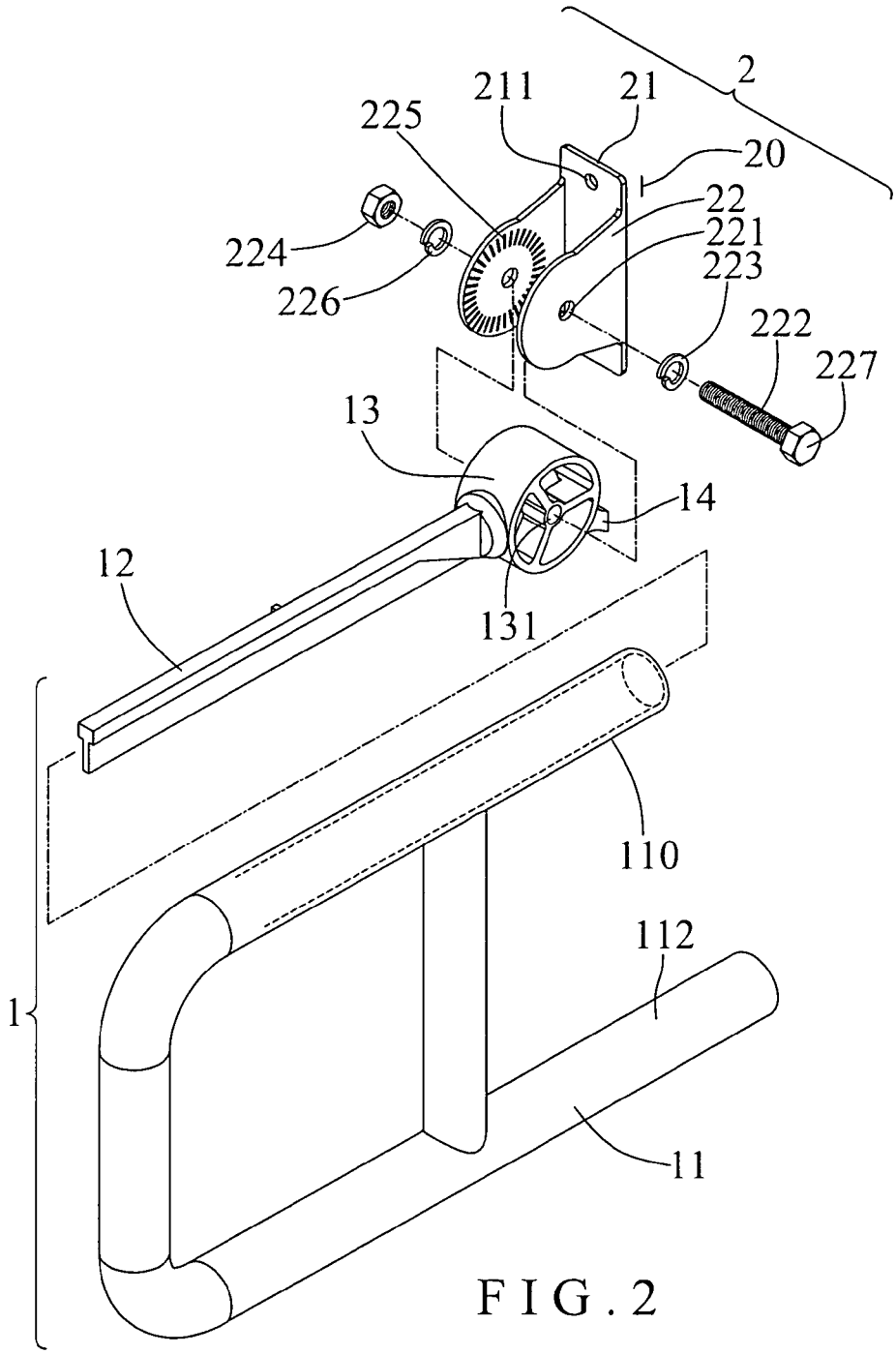
FIG. 2 is an exploded perspective view of the safety rail in accordance with the preferred embodiment of the present invention.
Figure 3:
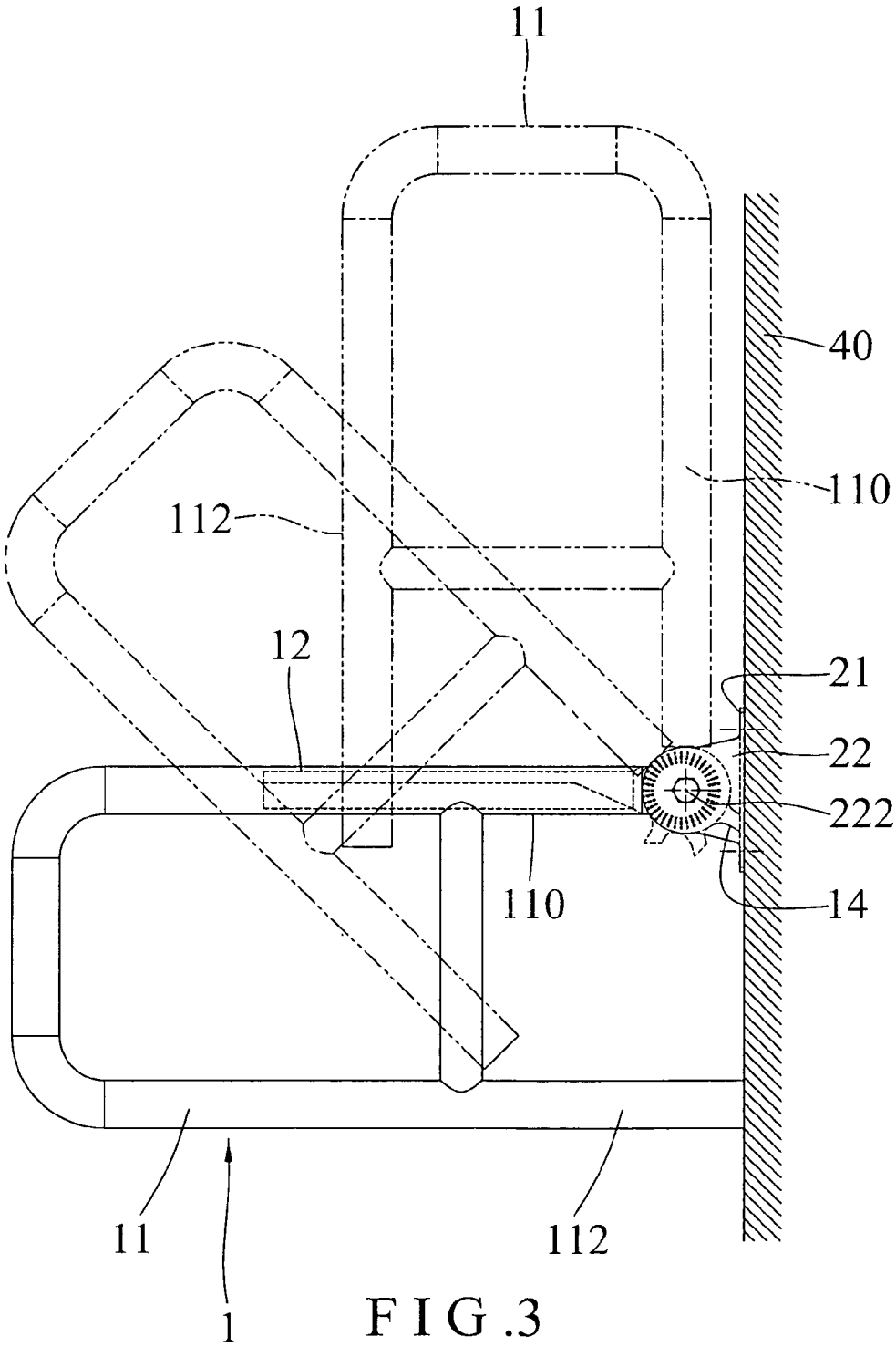
FIG. 3 is a plan cross-sectional operational view of the safety rail in accordance with the preferred embodiment of the present invention.

Referring to the drawings and initially to FIGS. 1–3, a safety rail in accordance with the preferred embodiment of the present invention comprises at least one fixing seat 2 attachable to a wall 40, and at least one armrest body 1 pivotally mounted on the at least one fixing seat 2 to facilitate a user holding the at least one armrest body 1. In the preferred embodiment of the present invention, the safety rail comprises a fixing seat 2, and an armrest body 1 pivotally mounted on the fixing seat 2.

The fixing seat 2 includes a support member 20 attachable to the wall 40. The support member 20 of the fixing seat 2 has a substantially U-shaped cross-sectional profile and has a bottom plate 21 and two opposite side plates 22 each extending outward from the bottom plate 21. The bottom plate 21 of the support member 20 is formed with at least one fixing hole 211 for attaching the bottom plate 21 of the support member 20 to the wall 40. Each of the side plates 22 of the support member 20 is formed with a through hole 221. Each of the side plates 22 of the support member 20 is substantially semi-circular and has an inner face provided with a plurality of radially arranged serrated portions 225 arranged in an annular manner.

The armrest body 1 includes a rotation member 13 rotatably mounted between the side plates 22 of the support member 20 of the fixing seat 2, a support bar 12 mounted on and extended from an outer periphery of the rotation member 13, a limit member 14 mounted on and extended from the outer periphery of the rotation member 13 and movable to rest on the bottom plate 21 of the support member 20 of the fixing seat 2 when the support bar 12 is located at a horizontal state, and an armrest frame 11 mounted on the support bar 12.

The rotation member 13 of the armrest body 1 has a substantially cylindrical shape and has a central portion formed with an axial hole 131. The rotation member 13 of the armrest body 1 has two opposite sides each rested on the serrated portions 225 of the respective side plate 22 of the support member 20. The support bar 12 of the armrest body 1 has a substantially T-shaped cross-sectional profile. The armrest frame 11 of the armrest body 1 is substantially U-shaped and has a first portion 110 mounted on the support bar 12 and a second portion 112 that is movable to rest on the wall 40 when the support bar 12 is located at a horizontal state. The first portion 110 of the armrest frame 11 of the armrest body 1 is located at a horizontal state when the support bar 12 is located at a horizontal state. The first portion 110 and second portion 112 of the armrest frame 11 of the armrest body 1 have a tubular shape.

The fixing seat 2 further includes a threaded rod 222 extended through the through hole 221 of each of the side plates 22 of the support member 20 and the axial hole 131 of the rotation member 13 of the armrest body 1, a nut 224 screwed onto the threaded rod 222, a first elastic washer 223 mounted on the threaded rod 222 and located between one of the side plates 22 of the support member 20 and an enlarged head 227 of the threaded rod 222, and a second elastic washer 226 mounted on the threaded rod 222 and located between the other one of the side plates 22 of the support member 20 and the nut 224.

When in use, when the support bar 12 of the armrest body 1 is located at the horizontal state, the first portion 110 of the armrest frame 11 of the armrest body 1 is located at the horizontal state. At this time, the limit member 14 is rested on the bottom plate 21 of the support member 20 of the fixing seat 2, and the second portion 112 of the armrest frame 11 of the armrest body 1 is rested on the wall 40, so that the first portion 110 of the armrest frame 11 of the armrest body 1 is located at the horizontal state rigidly and stably, thereby facilitating a user holding the armrest frame 11 of the armrest body 1 so as to provide a support effect to the user.

As shown in FIG. 3 with reference to FIGS. 1 and 2, the rotation member 13 of the armrest body 1 is rotatable relative to the support member 20 of the fixing seat 2 to a position where the support bar 12 and the armrest frame 11 of the armrest body 1 are parallel with the bottom plate 21 of the support member 20 of the fixing seat 2 and parallel with the wall 40 to fold the armrest body 1 so as to fold the safety rail, so that the safety rail is folded when not in use, thereby saving the space occupied by the safety rail.

Figure 4:
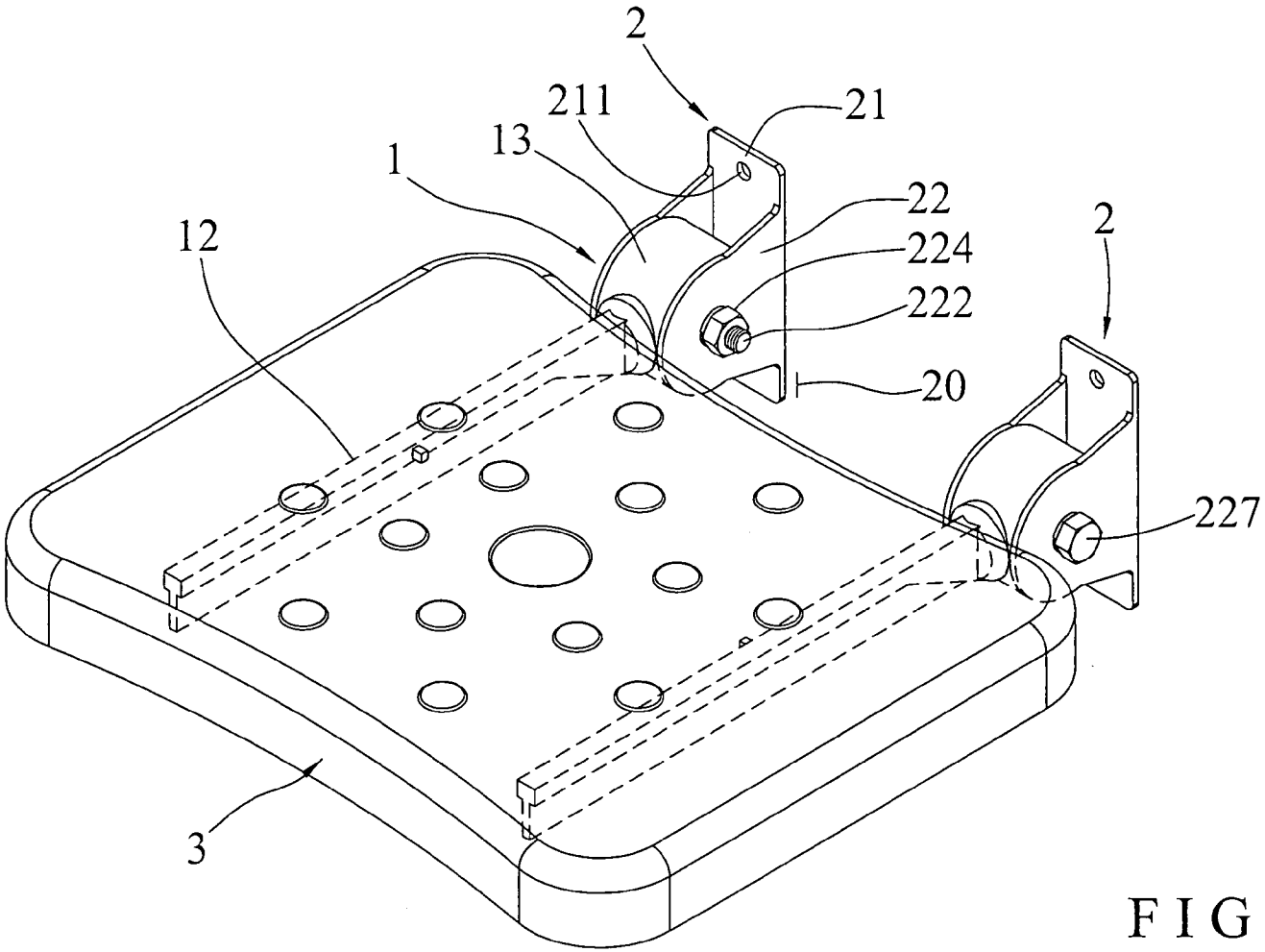
FIG. 4 is a perspective view of a safety rail in accordance with another preferred embodiment of the present invention.

As shown in FIG. 4, the safety rail comprises two fixing seats 2, and two armrest bodies 1 each pivotally mounted on the respective fixing seat 2, and further comprises a cushion 3 supported by the support bars 12 of the two armrest bodies 1, so that the safety rail functions as a chair.

Accordingly, the armrest frame 11 of the armrest body 1 is located at the horizontal state rigidly and stably when in use so that a user holds safely the armrest frame 11 of the armrest body 1 so as to provide a support effect to the user. In addition, the armrest frame 11 of the armrest body 1 is movable to be parallel with the wall 40, so that the safety rail is folded when not in use, thereby saving the space occupied by the safety rail. Further, the safety rail functions as a chair, thereby enhancing the versatility of the safety rail.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A safety rail, comprising:

at least one fixing seat attachable to a wall;

at least one armrest body pivotally mounted on the at least one fixing seat;

wherein the fixing seat includes a support member having a bottom plate and two opposite side plates each extending outward from the bottom plate;

the armrest body includes a rotation member rotatably mounted between the side plates of the support member of the fixing seat, a support bar mounted on and extending from an outer periphery of the rotation member, and an armrest frame mounted on the support bar;

the armrest body further includes a limit member mounted on and extended from the outer periphery of the rotation member and movable to rest on the bottom plate of the support member of the fixing seat when the support bar is located at a horizontal state.

2. The safety rail in accordance with claim 1, wherein the rotation member of the armrest body is rotatable to the support member of the fixing seat to a position where the support bar and the armrest frame of the armrest body are parallel with the bottom plate of the support member and parallel with the wall.

3. The safety rail in accordance with claim 1, wherein the safety rail comprises two fixing seats, and two armrest bodies each pivotally mounted on the respective fixing seat, and further comprises a cushion supported by the support bars of the two armrest bodies, so that the safety rail functions as a chair.

4. The safety rail in accordance with claim 1, wherein the support member of the fixing seat has a substantially U-shaped cross-sectional profile.

5. The safety rail in accordance with claim 1, wherein the bottom plate of the support member is formed with at least one fixing hole for attaching the bottom plate of the support member to the wall.

6. The safety rail in accordance with claim 1, wherein the armrest frame of the armrest body is substantially U-shaped.

7. The safety rail in accordance with claim 1, wherein the rotation member of the armrest body has a substantially cylindrical shape.

8. The safety rail in accordance with claim 1, wherein the support bar of the armrest body has a substantially T-shaped cross-sectional profile.

9. The safety rail in accordance with claim 1, wherein each of the side plates of the support member is substantially semi-circular.

10. The safety rail in accordance with claim 1, wherein each of the side plates of the support member is formed with a through hole, the rotation member of the armrest body has a central portion formed with an axial hole, and the fixing seat further includes a threaded rod extended through the through hole of each of the side plates of the support member and the axial hole of the rotation member of the armrest body, and a nut screwed onto the threaded rod.

11. The safety rail in accordance with claim 10, wherein the fixing seat further includes a first elastic washer mounted on the threaded rod and located between one of the side plates of the support member and an enlarged head of the threaded rod, and a second elastic washer mounted on the threaded rod and located between the other one of the side plates of the support member and the nut.

* * * * *